US009142326B2

(12) United States Patent
Shaw et al.

(10) Patent No.: US 9,142,326 B2
(45) Date of Patent: Sep. 22, 2015

(54) RADIOACTIVE WASTE STORAGE

(75) Inventors: Ian Shaw, Warrington (GB); Antony Gaffka, Warrington (GB)

(73) Assignee: Soletanche Freyssinet SA (FR)

( * ) Notice: Subject to any disclaimer, the term of this patent is extended or adjusted under 35 U.S.C. 154(b) by 1192 days.

(21) Appl. No.: 12/757,135

(22) Filed: Apr. 9, 2010

(65) Prior Publication Data

US 2010/0324350 A1 Dec. 23, 2010

(30) Foreign Application Priority Data

Apr. 9, 2009 (GB) ..... 0906143.3

(51) Int. Cl.
*G21F 5/005* (2006.01)
*G21F 9/34* (2006.01)
*G21F 9/36* (2006.01)

(52) U.S. Cl.
CPC *G21F 5/005* (2013.01); *G21F 9/34* (2013.01); *G21F 9/36* (2013.01)

(58) Field of Classification Search
None
See application file for complete search history.

(56) References Cited

U.S. PATENT DOCUMENTS 3,885,922 A * 5/1975 Thomas et al. ..... 428/683
4,292,528 A * 9/1981 Shaffer et al. ..... 250/506.1
4,834,917 A * 5/1989 Ramm et al. ..... 588/15
4,847,505 A * 7/1989 Suthanthiran ..... 250/507.1
5,566,727 A * 10/1996 Erbse et al. ..... 141/7
5,696,089 A * 12/1997 Felix et al. ..... 514/11.2
5,789,648 A * 8/1998 Roy et al. ..... 588/1
7,590,213 B1 * 9/2009 Singh ..... 376/274
8,049,194 B2 * 11/2011 Nicholson et al. ..... 250/507.1
8,348,551 B2 * 1/2013 Baker et al. ..... 405/128.85

FOREIGN PATENT DOCUMENTS

| | | | |
|---|---|---|---|
| FR | 2615650 | | 11/1988 |
| JP | 0-7156945 | * | 7/1988 |
| JP | 402025799 | * | 1/1990 |
| JP | 6294895 | | 10/1994 |
| JP | 407156945 | * | 6/1995 |

OTHER PUBLICATIONS

GB Intellectual Property Office Search Report for GB0906143.3 dated Sep. 29, 2009.

* cited by examiner

*Primary Examiner* — Melvin C Mayes
*Assistant Examiner* — Sheng H Davis
(74) *Attorney, Agent, or Firm* — Tumey L.L.P.

(57) ABSTRACT

Radioactive waste may be stored in storage containers that are suitable for long-term disposal, but do not provide adequate shielding. By assembling an overpack from metal plates, the metal plates each being substantially flat, and the overpack providing sufficient shielding for the radioactive waste, and enclosing the storage container that contains radioactive waste in the overpack, the storage container can then be stored safely in a weatherproof enclosure. The enclosure does not need to provide radiation shielding. The plates can be stored as a flat-pack, and assembled into the overpack when required.

12 Claims, 1 Drawing Sheet

RADIOACTIVE WASTE STORAGE

U.K. Application No. 0906143.3 filed Apr. 9, 2009 is hereby incorporated by reference in its entirety.

This invention relates to a method for storing radioactive waste, and to overpacks for use in such a storage method.

Storage of radioactive waste, for example intermediate level waste, in sealed storage containers or boxes in a storage facility is known. The storage containers would usually be of a standard size, as specified for final disposal, such as 3 $m^3$ boxes or 500 liter drums. The storage containers are intended to be suitable for long-term disposal, but are not intended to provide shielding. Because radioactive waste emits ionising radiation, such as gamma rays, such storage containers must be provided with shielding. Such a storage facility would typically be provided with shielding walls, for example of concrete, that define a storage vault in which the boxes may be placed. A mechanism such as a travelling crane would be provided to enable boxes to be installed in, or removed from, the vault. Such a storage facility enables radioactive material to be stored safely, protected from the environment, while enabling individual boxes to be retrieved and inspected if required. However the storage vault is expensive to construct, because the walls of the vault have to provide effective shielding.

According to a first aspect, the present invention provides a method for storing radioactive waste in storage containers, comprising the steps of:

assembling an overpack from metal plates, the metal plates each being substantially flat, and the overpack providing sufficient shielding for the radioactive waste;

enclosing a storage container that contains radioactive waste in the overpack; and storing the overpack that contains the storage container in a weatherproof enclosure.

In a second aspect, the invention provides an overpack for a storage container for radioactive waste, the overpack being assembled from metal plates, the metal plates each being substantially flat, and the overpack providing sufficient shielding for the radioactive waste.

In a third aspect, the invention provides a kit for making such an overpack, the kit comprising the requisite metal plates, and connectors to join them together. The kit may be in the form of a flat-pack. Preferably the plates forming the sides are all identical.

Preferably the metal plates are of steel or cast iron. Preferably each wall of the overpack (i.e. the base, the sides and the lid) consists of a single metal plate. Each metal plate may be of laminate construction. Each metal plate may be of thickness at least 75 mm, preferably no more than 300 mm, more preferably between 100 mm and 200 mm, for example between 140 mm and 160 mm. For example a metal plate of thickness 150 mm may be formed of two metal sheets each of thickness 75 mm, secured together for example using bolts or welding. Such a thickness provides adequate shielding, without being unnecessarily heavy. The shielding for the radioactive waste is such that a container of intermediate level waste, when enclosed in an overpack, can be safely handled by an operator. It will be appreciated that different types of waste may require containers with walls of different thicknesses.

Since the metal plates are provided for shielding, they may be of mild steel. Preferably the overpack is also provided with spacers to separate the metal of the metal plates from the storage container itself, to minimise the risk of corrosion. Such spacers may be of stainless-steel, or of a non-metallic material such as ceramic.

Because the overpack provides adequate and sufficient shielding for the radioactive waste, the weatherproof enclosure does not have to be an expensive structure, as it does not have to provide shielding against radiation. As a further consequence, the overpacks that contain storage boxes do not have to be installed or moved remotely, using a crane; instead they can be maneuvered by operators using forklift trucks.

Before the overpacks are needed, the metal plates can be stored as a stack or a flat-pack, as they are substantially flat, which minimises the space that they occupy (as compared to preformed overpacks). And after use, which may be for a period of many years, each overpack can be disassembled. It may subsequently be reassembled for reuse, or alternatively the metal can be recycled, as the metal itself is uncontaminated by its use and has considerable value as scrap.

In the assembly of the overpack, the metal plates may be connected together using bolts screwed into preformed threaded holes. Preferably each hole provides a recess into which the head of the bolt locates, so after assembly the heads do not project above the surface. There may also be metal dowels that locate into preformed holes. Preferably the edges of the metal plates are stepped, so that the mating edges are of stepped shape, so ensuring there is no risk of a shine-through path at an edge or corner of the overpack.

Preferably the base of the overpack is provided with projecting feet, which may be bolted on. This ensures that the assembled overpacks can be stacked on top of each other, the projecting feet providing a sufficient gap for the projecting forks of a fork lift truck to fit underneath the overpack. Preferably the overpack is provided with fittings, which may be bolted on, to enable it to be lifted by a crane; such fittings may be attached to the sides. The lid may also be provided with a lifting point, so the lid may be lifted off.

The invention will now be further and more particularly described, by way of example only, and with reference to the accompanying drawings, in which.

Figure 1:
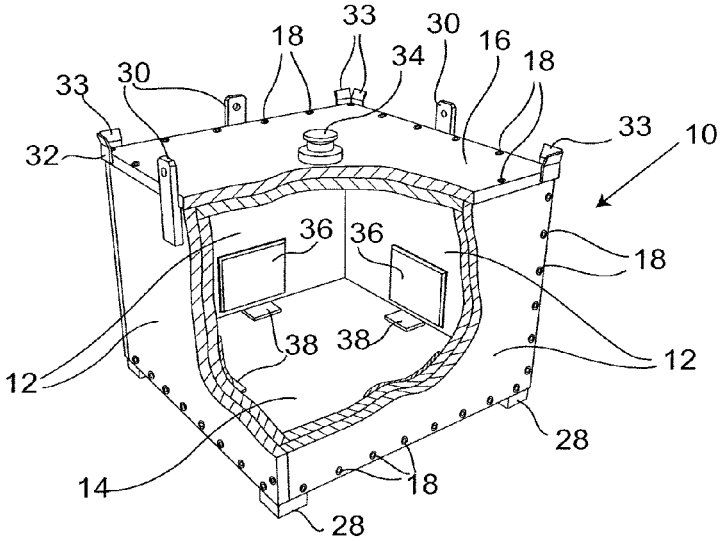
FIG. 1 shows a perspective view of an overpack, partly cut away.

Referring to FIG. 1, an overpack 10 for storage of a container of radioactive waste consists of a box assembled from 150 mm thick steel plates: four side walls 12, a base 14 and a lid 16. Each steel plate consists of two mild steel sheets of thickness 75 mm, as described in more detail below. The steel plates are secured to each other by steel bolts 18 that screw into threaded holes, each hole providing a recess into which the head of the bolt 18 locates, so that the heads of the bolts 18 do not protrude above the surface. By way of example such an overpack 10 may be in the form of a square box, the sides being of width 2.08 m and of height 1.575 m, and would weigh about 20 tonnes.

Figure 3:
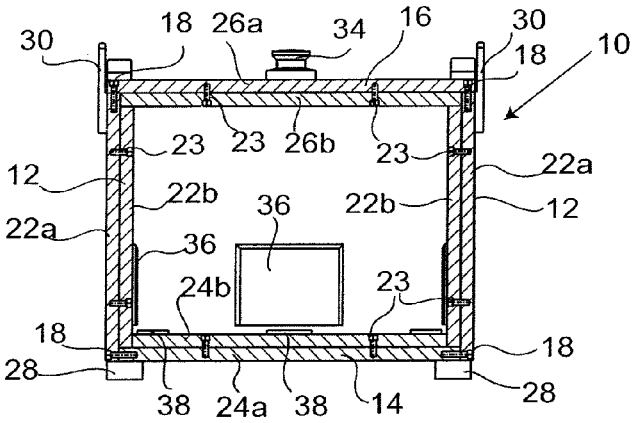
FIG. 3 shows a sectional view on the line A-A of FIG. 2.

Referring also to FIG. 3, considering the plates forming the walls 12, each consists of two steel sheets 22*a*, 22*b* attached to each other by bolts 23 in recesses on the surface forming the inside of the overpack 10, and the heads of the bolts 23 are covered by welding (so there is no local reduction in thickness, and so of shielding). Similarly the plate forming the base 14 consists of two steel sheets 24*a*, 24*b* secured together by recessed bolts 23 that are covered by welding, and the plate forming the lid 16 consists of two steel plates 26*a*, 26*b* secured together by recessed bolts 23 that are covered by welding. In each case the inner plate 22*b*, 24*b* and 26*b* is smaller than the corresponding outer plate 22*a*, 24*a* or 26*a* by 150 mm in each direction, so that the outer plate projects by 75 mm beyond the edges of the inner plate. Consequently the mating edges of adjacent plates are all stepped.

Steel feet 28 are welded or bolted to the plate forming the base 14, one at each corner, and projecting 75 mm beyond the corner of the base 14 in each direction, so that they extend to the corner of the assembled overpack 10. Each steel foot 28 is 100 mm thick.

Figure 2:
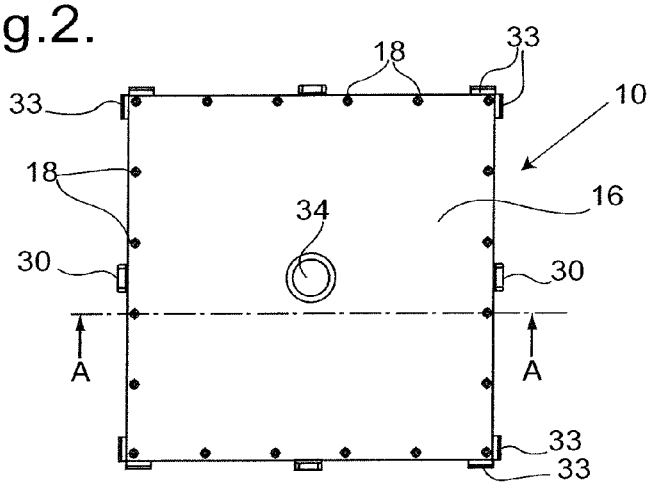
FIG. 2 shows a plan view of the overpack of FIG. 1.

Referring also to FIG. 2, each plate forming a side wall 12 is provided at its midpoint with a rectangular lifting lug 30 welded (or bolted) onto its outside surface, and extending above the top edge of the side wall 12 so as to project above the lid 16 of the assembled overpack 10. These lugs 30 also act as location guides when the lid 16 is installed. At each corner, a corner plate 32 is welded (or bolted) to the plate forming the lid 16, this extending above the top of the lid 16 to provide outwardly-flared upstands 33. At the centre of the plate forming the lid 16 a lifting pintle 34 is attached by bolts.

As shown in FIGS. 1 and 3, stainless-steel spacer plates 36 are attached to each wall 12, towards the bottom of the wall 12; and stainless-steel spacer plates 38 are attached to the base 14, near the middle of each wall 12.

The overpack 10 can be assembled by placing the plate forming the base 14 on a flat surface; lifting each plate forming a side wall 12 into position, one at a time, for example using the lifting lug 30, and inserting the requisite bolts 18; and when required, the plate forming the lid 16 can be lifted into position using the lifting pintle 34.

In use of the overpacks 10, the plates 12, 14 and 16 can be stored disassembled until they are required. When a container of intermediate level waste is to be put into store, an overpack 10 is assembled, attaching the walls 12 to the base 14 as described above. The container of intermediate level waste is then placed inside the overpack 10, and the lid 16 lifted into position, and secured with the bolts 18. The overpack 10 provides sufficient shielding against radiation that the container of intermediate level waste enclosed within the overpack can then be safely handled, for example by an operator using a fork lift truck. If the overpacks 10 are to be stacked on top of each other, then the lifting pintle 34 would first be removed.

The overpacks 10 containing containers of intermediate level waste can be stored in a warehouse or similar weatherproof structure. The storage building does not have to provide radiation shielding, and therefore a comparatively cheap structure is adequate. This has the benefit that the processing and storage of intermediate level waste, for example at a nuclear power station, can be initiated without first requiring a shielded waste store to be built: not only does this save money, but it enables an earlier start to the processing of intermediate level waste.

During storage, which may last several years, the spacer plates 36 and 38 ensure that the metal of the waste container and the steel of the overpack 10 are kept apart, so reducing the risk of corrosion. If at any time there is a requirement for inspection or maintenance of the waste containers, this can be readily achieved by transporting the overpack 10, for example with a fork lift truck, into a shielded building or a shielded working area. After attaching a lifting pintle 34, and removal of the lid-securing bolts 18, the lid 16 can be lifted off.

When the container of intermediate level waste is to be sent for final disposal at a disposal site, the overpack 10 enclosing the container would be transported into a shielded building or workplace. The lid 16 can then be removed. The container is then lifted out, and placed into a standard transport package, and can then be transported to the disposal site.

The overpack 10 may then be reused; or may be disassembled and stored for subsequently use; or it may be disassembled and sold as scrap material. Since it consists only of uncontaminated steel, it can be expected to have significant value as scrap.

In some cases it may be acceptable to transport an overpack 10 enclosing a container of waste material to a disposal site; then to remove the container for disposal; and then to dismantle or return the overpack 10.

In some cases, where the contents of the container of radioactive waste may produce hydrogen gas, it is known to provide the container with a sintered metal filter, so any such hydrogen gas can diffuse out. Under these circumstances a narrow groove may be provided across the top surface of at least one of the side walls 12, for example 1 mm wide and 1 mm deep, extending across the stepped top surface of the side wall 12. When the overpack 10 is closed with the lid 16, this narrow groove ensures that the overpack 10 is not hermetically sealed, so that any hydrogen emerging from the container of radioactive waste can escape to the environment.

The overpack 10 of the dimensions described above is suitable for storage of a standard 3 $m^3$ radioactive waste container. It would also be suitable for containing four 500 liter waste-containing drums. The invention also envisages overpacks of different sizes, for example to contain six 200 liter drums. Indeed smaller overpacks can also be envisaged, for example to store fewer 500 liter or 200 liter waste drums.

The invention claimed is:

1. An overpack for a storage container for radioactive waste, the overpack being assembled from metal plates each forming a wall of the overpack, the metal plates each being substantially flat and comprising an inner plate and an outer plate of laminate construction, and the overpack providing sufficient shielding for the radioactive waste, wherein the overpack is provided with spacers that are smaller than the metal plates to separate the metal plates from a storage container during use, and wherein the outer plate projects beyond an edge of the inner plate, so that mating edges of the metal plates are of stepped shape, so ensuring there is no risk of a shine-through path at the mating edges and the corners of the overpack.

2. An overpack as claimed in claim 1 wherein the metal plates are of steel or cast iron.

3. An overpack as claimed in claim 1 wherein each wall of the overpack consists of a single metal plate.

4. An overpack as claimed in claim 3 wherein each wall of the overpack comprises a mild steel sheet.

5. An overpack as claimed in claim 1 wherein each metal plate is of thickness between 75 mm and 300 mm.

6. An overpack as claimed in claim 1 also comprising bolts connecting the plates together.

7. An overpack as claimed in claim 1 also comprising a sintered metal filter arranged so that hydrogen gas can escape from the overpack.

8. An overpack as claimed in claim 1 wherein the spacers are of stainless steel.

9. An overpack as claimed in claim 1 where the spacers are of a non-metallic material, wherein the non-metallic material is a ceramic.

10. An overpack as claimed in claim 1 wherein the spacers comprise stainless steel spacer plates.

11. An overpack as claimed in claim 1 wherein the spacers are attached to each wall formed by one of the metal plates.

12. A kit for making an overpack as claimed in claim 1, the kit comprising the metal plates, connectors to join them together, and spacers that are smaller than the metal plates.

* * * * *